US006752556B2

(12) United States Patent
Pearce

(10) Patent No.: US 6,752,556 B2
(45) Date of Patent: Jun. 22, 2004

(54) SWEAT ABSORBENT SLEEVE FOR PENS AND PENCILS

(76) Inventor: Richard J. Pearce, 14350 Braun Rd., Golden, CO (US) 80401

( * ) Notice: Subject to any disclaimer, the term of this patent is extended or adjusted under 35 U.S.C. 154(b) by 0 days.

(21) Appl. No.: 10/252,216

(22) Filed: Sep. 23, 2002

(65) Prior Publication Data

US 2004/0057772 A1 Mar. 25, 2004

(51) Int. Cl.[7] ..... A46B 5/02; A45D 40/20
(52) U.S. Cl. ..... 401/6; 401/88; 16/430
(58) Field of Search ..... 401/6, 88, 50, 401/54; 16/430

(56) References Cited

U.S. PATENT DOCUMENTS

| | | | | |
|---|---|---|---|---|
| 1,971,681 A | | 8/1934 | Hauton | |
| 2,236,194 A | | 3/1941 | Lorber | |
| 4,030,841 A | | 6/1977 | Balasty | |
| 4,167,347 A | | 9/1979 | Hoyle | |
| 4,601,598 A | | 7/1986 | Schwartz | |
| D286,650 S | | 11/1986 | Fischer | |
| 4,832,604 A | | 5/1989 | Rusk | |
| 5,056,945 A | * | 10/1991 | Klodt | 401/6 |
| D359,758 S | | 6/1995 | Inami | |
| 5,468,083 A | | 11/1995 | Chesar | |
| D396,059 S | | 7/1998 | Plantz et al. | |
| 5,876,134 A | | 3/1999 | Tseng et al. | |
| 5,882,667 A | | 3/1999 | Jones | |
| 5,926,901 A | | 7/1999 | Tseng et al. | |
| 5,933,870 A | * | 8/1999 | Egan et al. | 2/209.13 |
| D414,807 S | | 10/1999 | Baudino et al. | |
| 6,019,533 A | | 2/2000 | Smith | |
| 6,062,753 A | | 5/2000 | Hadtke et al. | |
| 6,186,685 B1 | | 2/2001 | Salemme | |
| 6,273,626 B1 | | 8/2001 | Yazawa | |
| 6,296,409 B1 | | 10/2001 | Cherry et al. | |
| 6,511,732 B1 | * | 1/2003 | Chao | 428/138 |

* cited by examiner

*Primary Examiner*—David J. Walczak
(74) *Attorney, Agent, or Firm*—Dennis G. LaPointe; Mason Law, P.L.

(57) ABSTRACT

A water absorbent sleeve can be positioned on a writing implement to prevent the slipping of the writing instrument caused from a user's sweaty palm or fingers.

46 Claims, 2 Drawing Sheets

SWEAT ABSORBENT SLEEVE FOR PENS AND PENCILS

The invention relates to a pen or pencil sleeve, which absorbs sweat so that a person's fingers do not slip on the pen or pencil when handling the pen or pencil over an extended period.

The present invention is directed to a sweat absorbing finger-gripping device for use as a permanent or preferably a removable attachment to a writing implement. The finger-gripping device comprises a water or moisture absorbent sleeve to absorb sweat from the fingers of the person using the implement. The cylindrically-shaped sleeve has a formed internal bore or hollow portion sized to snugly fit around the writing instrument. The water absorbent sleeve forms a finger contacting surface when the sleeve is carried on a writing implement. The water absorbent layer absorbs sweat from the palm and/or fingers of the user sot the writing instrument does not slip in the user's palm and/or fingers.

The sleeve can be formed with an internal layer, which can be coated with an adhesive to prevent the finger-gripping device from sliding on the writing implement.

The sleeve also has an outer permeable fabric layer with a moisture absorbing layer sandwiched between the internal layer, which can also be coated with an adhesive layer, preferably a releasable adhesive layer.

The water absorbent sleeve can be formed from a layered or laminated material such as material used to make CARE-FREE® panty liner feminine sanitary protection products.

The cylindrically-shaped sleeve can be perforated circumferentially at spaced intervals to allow removal of sections to compensate for reduced length of a pencil as the pencil is sharpened.

The water or moisture absorbent sleeve can be initially woven as a cylindrical fabric, or can be formed by bringing opposing edges of a flat sheet of layered material into contact and securing the opposing edges to form a cylindrical configuration. The seam or joint can be by bonding or stitching, or can be seamless.

As stated above, a water permeable layer is positioned on the finger contacting side of the cylindrical water absorbent sleeve to wick moisture from the fingers into the moisture absorbent layer.

The present invention further includes the permanent combination of a writing implement and a finger-gripping device.

DETAILED DESCRIPTION OF THE INVENTION

Figure 1A:
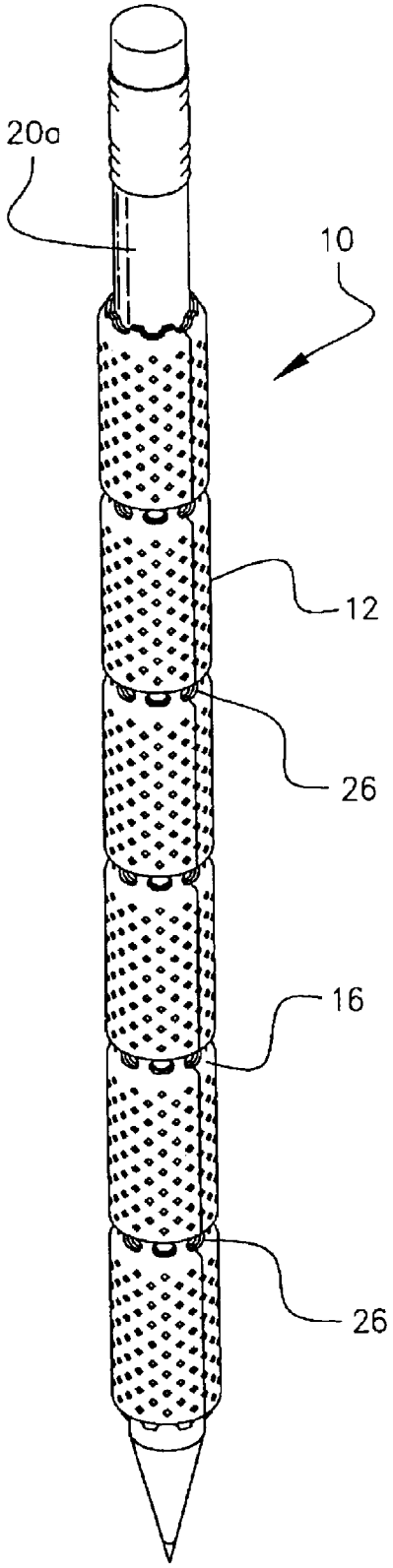
FIG. 1A shows a water absorbent sleeve on a writing implement (pencil shown)
Figure 1B:
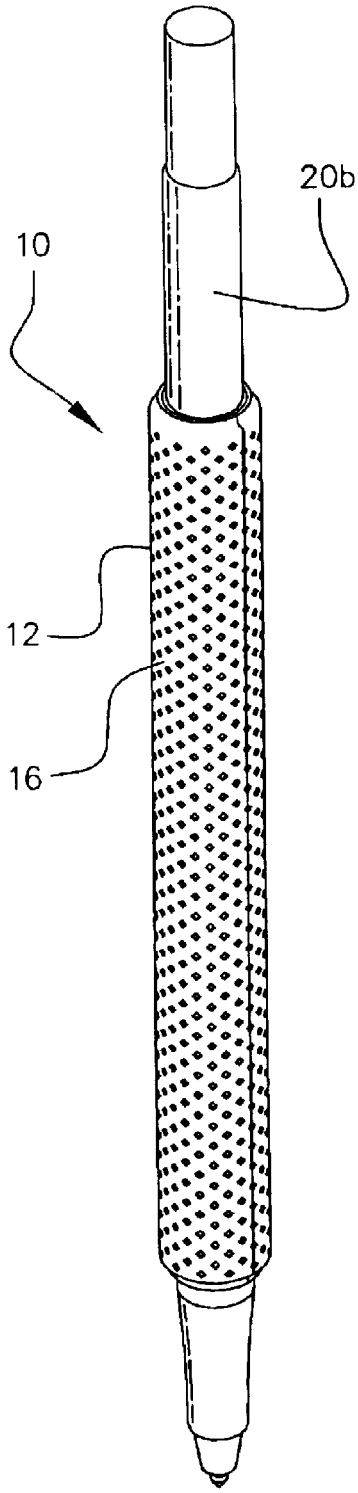
FIG. 1B shows a water absorbent sleeve on a writing implement (pen shown)
Figure 2:
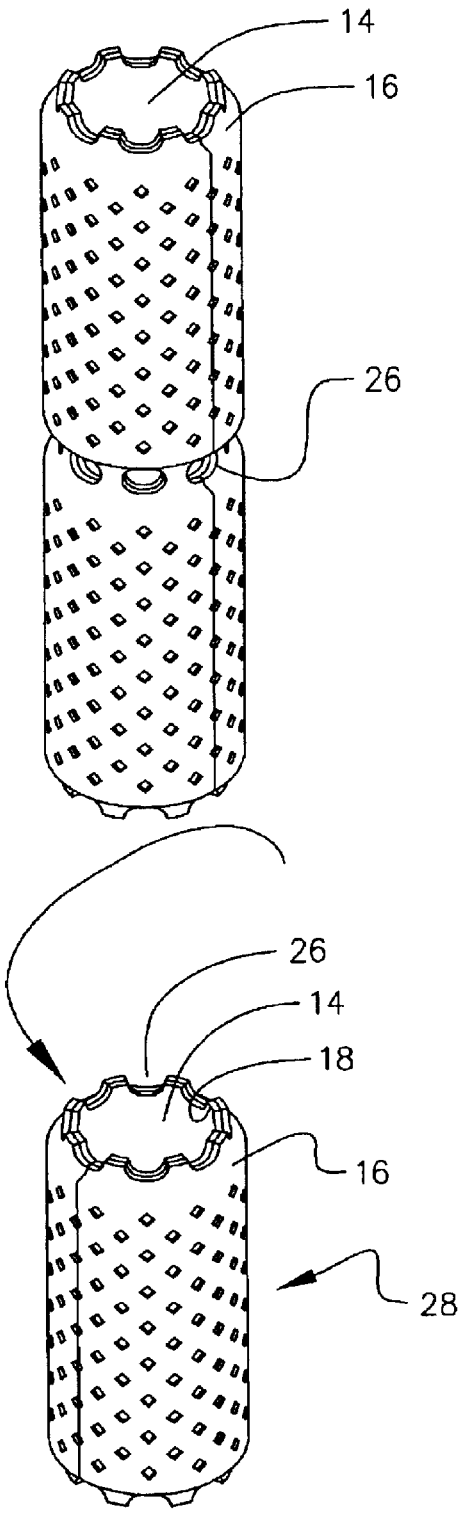
FIG. 2 depicts one embodiment of the invention where sectional portion of the sleeve can be torn off (separated) as a pencil is shortened.
Figure 3:
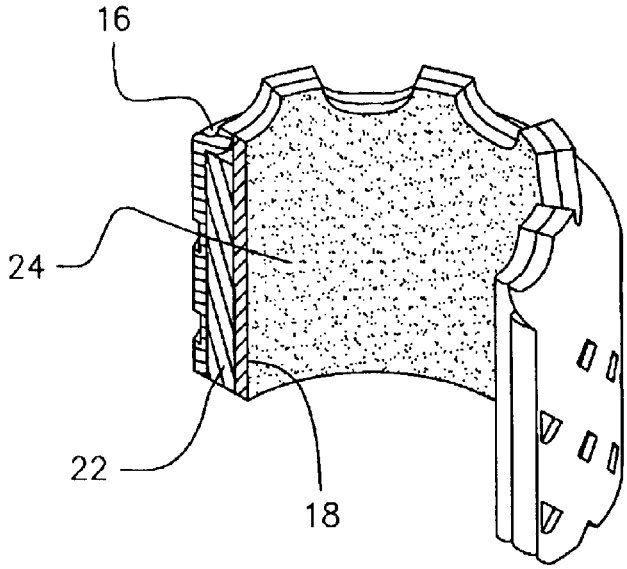
FIG. 3 depicts a cross-section view of a partial section of one of the sections from FIG. 2.
Figure 4:
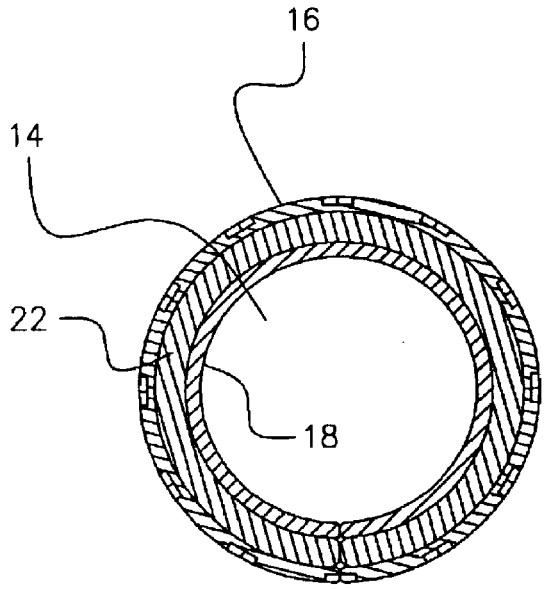
FIG. 4 depicts a plan cross-section view of one of the sections from FIG. 2.

Turning now to FIGS. 1A and 1B, 2, 3 and 4, there is shown a water absorbent sleeve 10 having a finger contacting surface 12, and a formed bore or hollow portion 14 designed to snugly fit around a writing implement. The sleeve can be formed as a multi-layered device, typically, three layers, a fabric layer 16 on the outside, a sleeve internal or inner layer 18 which is formed to snugly fit around the writing implement 20*a*,20*b*, and an intermediate moisture absorbing layer 22 sandwiched in between. The sleeve internal layer 18 is generally made from an impervious material and can be coated with an adhesive 24 to prevent the water absorbent sleeve 10 from sliding on the writing implement 20*a*,20*b*. Adhesive 24 can be a permanent adhesive for mechanical pencils 20*a* or pens 20*b*, although a releasable adhesive would be advantageous so as to be able to temporarily remove the sleeve 10 from the implement 20*a*,20*b* for reuse on other writing implements.

The water absorbent sleeve's outer fabric layer 16 preferably has perforations 26 around its circumference at spaced-apart intervals to provide for reduction in length to correspond to reduction in length of the writing implement, when the writing implement is a pencil 20*a*.

Outer layer 16, which forms the finger contacting surface 12, is typically a woven fabric such as nylon, cotton or synthetic material which will be sufficiently durable to be used repetitively. The outer layer 16 could also be preformed non-fabric material such as leather, elastomeric, polymeric, and synthetic materials, as long as the material selected is sufficiently permeable to allow any sweat to permeate into the sweat absorbing intermediate layer 22. This intermediate sweat absorbing layer 22 can be a cotton fibrous or other loosely woven fibrous material sufficient to readily absorb the sweat moisture and the permeation in the outer layer 16 should be porous enough to allow for the intermediate layer to dry after a period of non-use.

Because pencils have to be sharpened, it is recommended that the sleeve 10 have spaced-apart circumferential perforations 26, which allow for the tearing off or separation of sections as the pencil is shortened. These tear off perforations 26 can be typically spaced apart about very ½ inch to ¾ inches, although any increment spacing can be chosen. For mechanical pencils and pens, it is contemplated that the ability to tear off sections 28 is not necessary, and in fact, it is also contemplated that the sleeve 10 may be permanently adhered to the mechanical pencil or pen.

As can be ascertained from the above description, the inventive device 10 can be sized to fit any cross-sectionally shaped pen or pencil and can have any predetermined length to fit the pencil or pen.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

Now that the invention has been described,

What is claimed is:

1. A sweat absorbing finger-gripping device for use on a writing implement, the device comprising:

a cylindrically-shaped moisture absorbent sleeve, said moisture absorbent sleeve having an internal hollow portion sized to snugly fit the writing implement;

said moisture absorbent sleeve forming a finger contacting surface when said sleeve is used on the writing implement;

the moisture absorbent sleeve further having a permeable outer layer forming the finger contacting surface, an inner layer which is formed to snugly fit the writing implement, and a sweat absorbing intermediate layer sandwiched between the outer layer and the inner layer, wherein the permeable outer layer is sufficiently porous to allow for the wicking of sweat from a user's palm and fingers into the intermediate layer, thereby preventing the slipping of the writing implement in the user's palm or fingers, and wherein the inner layer further includes an adhesive coating for preventing the device from sliding on the writing implement when in use.

2. The device according to claim 1, wherein the permeable outer layer is one of a woven fabric material and non-fabric material.

3. The device according to claim 2, wherein the woven fabric material is made of material selected from the group consisting of cotton, nylon, and synthetic woven materials.

4. The device according to claim 2, wherein the non-fabric material is made of material selected from the group consisting of leather, elastomeric, polymeric, and synthetic materials.

5. The device according to claim 1, wherein the intermediate layer is made from a fibrous moisture absorbing material.

6. The device according to claim 5, wherein the fibrous moisture absorbing material is a cotton material.

7. The device according to claim 1, wherein the inner layer is made from an impervious material.

8. The device according to claim 1, wherein the adhesive coating is a releasable adhesive coating for facilitating the removal of the device from the writing instrument when desired.

9. The device according to claim 1, further comprising:

a plurality of spaced-apart circumferential perforations for facilitating the separation of sections of the cylindrically-shaped moisture absorbent sleeve.

10. The device according to claim 1, wherein the moisture absorbent sleeve is perforated around a cylindrical circumference at spaced intervals to allow for removal of sections to compensate for reduced length of a pencil as it is being shortened when sharpened.

11. The device according to claim 1, wherein the moisture absorbent sleeve is formed from a panty liner material.

12. A sweat absorbing finger-gripping device for use on a writing implement, the device comprising:

a cylindrically-shaped moisture absorbent sleeve, said moisture absorbent sleeve having an internal hollow portion sized to snugly fit the writing implement;

said moisture absorbent sleeve forming a finger contacting surface when said sleeve is used on the writing implement;

a plurality of spaced-apart circumferential perforations for facilitating the separation of sections of the cylindrically-shaped moisture absorbent sleeve; and the sleeve further comprising:

a permeable outer layer forming the finger contacting surface;

an inner layer which is formed to snugly fit the writing implement; and a sweat absorbing intermediate layer sandwiched between the outer layer and the inner layer, wherein the permeable outer layer is sufficiently porous to allow for the wicking of sweat from a user's palm and fingers into the intermediate layer, thereby preventing the slipping of the writing implement in the user's palm or fingers.

13. The device according to claim 12, wherein the permeable outer layer is one of a woven fabric material and non-fabric material.

14. The device according to claim 13, wherein the woven fabric material is made of material selected from the group consisting of cotton, nylon, and synthetic woven materials.

15. The device according to claim 13, wherein the non-fabric material is made of material selected from the group consisting of leather, elastomeric, polymeric, and synthetic materials.

16. The device according to claim 12, wherein the intermediate layer is made from a fibrous moisture absorbing material.

17. The device according to claim 16, wherein the fibrous moisture absorbing material is a cotton material.

18. The device according to claim 12, wherein the inner layer is made from an impervious material.

19. The device according to claim 12, wherein the inner layer further includes an adhesive coating for preventing the device from sliding on the writing implement when in use.

20. The device according to claim 19, wherein the adhesive coating is a releasable adhesive coating for facilitating the removal of the device from the writing instrument when desired.

21. The device according to claim 12, wherein the moisture absorbent sleeve is perforated around a cylindrical circumference at spaced intervals to allow for removal of sections to compensate for reduced length of a pencil as it is being shortened when sharpened.

22. The device according to claim 12, wherein the moisture absorbent sleeve is formed from a panty liner material.

23. A sweat absorbing finger-gripping device for use on a writing implement, the device comprising:

a cylindrically-shaped moisture absorbent sleeve, said moisture absorbent sleeve having an internal hollow portion sized to snugly fit the writing implement;

said moisture absorbent sleeve forming a finger contacting surface when said sleeve is used on the writing implement, and wherein the moisture absorbent sleeve is perforated around a cylindrical circumference at spaced intervals to allow for removal of sections to compensate for reduced length of a pencil as it is being shortened when sharpened; and the sleeve further comprising:

a permeable outer layer forming the finger contacting surface;

an inner layer which is formed to snugly fit the writing implement; and a sweat absorbing intermediate layer sandwiched between the outer layer and the inner layer, wherein the permeable outer layer is sufficiently porous to allow for the wicking of sweat from a user's palm and fingers into the intermediate layer, thereby preventing the slipping of the writing implement in the user's palm or fingers.

24. The device according to claim 23, wherein the permeable outer layer is one of a woven fabric material and non-fabric material.

25. The device according to claim 24, wherein the woven fabric material is made of material selected from the group consisting of cotton, nylon, and synthetic woven materials.

26. The device according to claim 24, wherein the non-fabric material is made of material selected from the group consisting of leather, elastomeric, polymeric, and synthetic materials.

27. The device according to claim 23, wherein the intermediate layer is made from a fibrous moisture absorbing material.

28. The device according to claim 27, wherein the fibrous moisture absorbing material is a cotton material.

29. The device according to claim 23, wherein the inner layer is made from an impervious material.

30. The device according to claim 23, wherein the inner layer further includes an adhesive coating for preventing the device from sliding on the writing implement when in use.

31. The device according to claim 30, wherein the adhesive coating is a releasable adhesive coating for facilitating the removal of the device from the writing instrument when desired.

32. The device according to claim 23, further comprising:

a plurality of spaced-apart circumferential perforations for facilitating the separation of sections of the cylindrically-shaped moisture absorbent sleeve.

33. The device according to claim 23, wherein the moisture absorbent sleeve is formed from a panty liner material.

34. The combination of a writing implement and a sweat absorbing finger-gripping device, the combination comprising:

a writing implement;

a sweat absorbing finger-gripping device on the writing implement, the device having a cylindrically-shaped moisture absorbent sleeve, said moisture absorbent sleeve having an internal hollow portion sized to snugly fit the writing implement;

said moisture absorbent sleeve forming a finger contacting; and the moisture absorbent sleeve further having:

a permeable outer layer forming the finger contacting surface, an inner layer which is formed to snugly fit the writing implement, and a sweat absorbing intermediate layer sandwiched between the outer layer and the inner layer, wherein the permeable outer layer is sufficiently porous to allow for the wicking of sweat from a user's palm and fingers into the intermediate layer, thereby preventing the slipping of the writing implement in the user's palm or fingers.

35. The combination according to claim 34, wherein the permeable outer layer is one of a woven fabric material and non-fabric material.

36. The combination according to claim 35, wherein the woven fabric material is made of material selected from the group consisting of cotton, nylon, and synthetic woven materials.

37. The combination according to claim 35, wherein the non-fabric material is made of material selected from the group consisting of leather, elastomeric, polymeric, and synthetic materials.

38. The combination according to claim 34, wherein the intermediate layer is made from a fibrous moisture absorbing material.

39. The combination according to claim 38, wherein the fibrous moisture absorbing material is a cotton material.

40. The combination according to claim 34, wherein the inner layer is made from an impervious material.

41. The combination according to claim 34, wherein the inner layer further includes an adhesive coating for preventing the device from sliding on the writing implement when in use.

42. The combination according to claim 41, wherein the adhesive coating is a releasable adhesive coating for facilitating the removal of the device from the writing instrument when desired.

43. The combination according to claim 34, further comprising:

a plurality of spaced-apart circumferential perforations for facilitating the separation of sections of the cylindrically-shaped moisture absorbent sleeve.

44. The combination according to claim 34, wherein the moisture absorbent sleeve is perforated around a cylindrical circumference at spaced intervals to allow for removal of sections to compensate for reduced length of a pencil as it is being shortened when sharpened.

45. The combination according to claim 34, wherein the moisture absorbent sleeve is formed from a panty liner material.

46. The combination according to claim 34, wherein the writing implement is one of a pen and pencil, including a mechanical pencil.

* * * * *